US012553155B2

(12) United States Patent
Strandberg et al.

(10) Patent No.: US 12,553,155 B2
(45) Date of Patent: Feb. 17, 2026

(54) ARRANGEMENT FOR SEPARATING A WOVEN TEXTILE INTO RECOVERED FIBERS AND TEXTILE RESIDUAL

(71) Applicant: Respin AB, Undersåker (SE)

(72) Inventors: Åsa Strandberg, Undersåker (SE); Peter Hoffman, Undersåker (SE); Kerstin Johansen, Linköping (SE)

(73) Assignee: Respin AB, Undersåker (SE)

( * ) Notice: Subject to any disclaimer, the term of this patent is extended or adjusted under 35 U.S.C. 154(b) by 0 days.

(21) Appl. No.: 18/846,054

(22) PCT Filed: Mar. 16, 2023

(86) PCT No.: PCT/EP2023/056793
§ 371 (c)(1),
(2) Date: Sep. 11, 2024

(87) PCT Pub. No.: WO2023/175098
PCT Pub. Date: Sep. 21, 2023

(65) Prior Publication Data

US 2025/0198057 A1 Jun. 19, 2025

(30) Foreign Application Priority Data

Mar. 18, 2022 (SE) ..... 2250342-9

(51) Int. Cl.
*D01G 11/04* (2006.01)

(52) U.S. Cl.
CPC ..... *D01G 11/04* (2013.01)

(58) Field of Classification Search
CPC ..... D01G 11/04
(Continued)

(56) References Cited

U.S. PATENT DOCUMENTS 3,775,856 A * 12/1973 Schmidt ..... E04F 21/22 33/526
3,775,956 A * 12/1973 Rajnoha ..... D01H 4/32 57/408

(Continued)

FOREIGN PATENT DOCUMENTS

CN 104411870 A * 3/2015 ..... D01H 15/00
CN 104711707 A 6/2015

(Continued)

OTHER PUBLICATIONS

International Search Report and Written Opinion from corresponding International Application No. PCT/EP2023/056793, dated Jun. 9, 2023, 13 pages.

*Primary Examiner* — Terrell H Matthews
(74) *Attorney, Agent, or Firm* — Ronald M. Kachmarik; Cooper Legal Group LLC

(57) ABSTRACT

An arrangement and a method for separating a woven textile into recovered fibers and textile residual. The recovered fibers can be reused in another textile at a later point in time, ensuring an environmentally friendly and energy efficient method for recycling woven textiles. The arrangement includes feeding means, a separating unit, and a fiber sorting device. The woven textile is separated into recovered fibers and textile residual by rotation of a brush roller arranged in the separating unit. Further, the fiber sorting device is arranged downstream the separating unit to collect the recovered fibers and textile residual. A sensor is arranged to monitor and determine the position of a downstream free end of the woven textile being fed to the separating unit. The arrangement further includes a control unit configured to control an operation of the feeding means, the separating unit and the fiber sorting device.

15 Claims, 11 Drawing Sheets

(58) Field of Classification Search
USPC ..... 209/3
See application file for complete search history.

(56) References Cited

U.S. PATENT DOCUMENTS

| | | | | | |
|---|---|---|---|---|---|
| 5,257,831 | A * | 11/1993 | Garcia | D01G 11/04 | 209/21 |
| 6,061,876 | A * | 5/2000 | Rowe | D01G 15/20 | 19/107 |
| 8,870,104 | B2 * | 10/2014 | Levy | B29B 17/02 | 241/24.19 |
| 2005/0113891 | A1 * | 5/2005 | Pederson | A61M 21/00 | 607/90 |
| 2017/0170241 | A1 * | 6/2017 | Huang | H10K 59/38 | |

FOREIGN PATENT DOCUMENTS

| | | | |
|---|---|---|---|
| CN | 106149103 | A * | 11/2016 |
| CN | 107142561 | A * | 9/2017 |
| EP | 0280900 | A1 * | 2/1988 |

* cited by examiner

ARRANGEMENT FOR SEPARATING A WOVEN TEXTILE INTO RECOVERED FIBERS AND TEXTILE RESIDUAL

TECHNICAL FIELD

Present invention relates to an arrangement for separating woven textile into recovered fibers and textile residual, and a corresponding method for separating woven textile.

BACKGROUND

The textile industry and the life cycle of textiles are often mentioned in the debate regarding environmental impact and pollution. As consumers grow increasingly aware of their own effect on the environment, more sustainable ways of taking care of textile waste material are requested. Further, it has become equally important for the industry to take action and promote more sustainable ways to take care of scrap material and decrease their environmental impact, in order to maintain relevant for consumers and to comply with environmental policies and regulations coming from a governmental level.

The production of textiles also contributes heavily to environmental impact and pollution. Using the cotton industry as an example, the production and processing of cotton uses large amounts of water, pesticides and fertilizers, which has a big impact on the environment in terms of pollution, contamination of water, soil degradation and biodiversity impacts, not to mention the health of cotton farmers and populations living nearby the farming areas.

Conventional methods of disposing of textile waste material include landfill and incineration, which could be problematic since textiles often cannot be decomposed naturally. Further, incineration of such textiles would lead to emittance of toxic gases and contribute to pollution. As an alternative to disposing of textile waste materials, there is recycling. For example, textiles could be recycled with chemical or mechanical recycling methods, wherein chemical recycling substantially includes a series of chemical processes to dissolve the fiber from the textile fabric, processes which often also requires large volumes of fresh water and use of energy.

Mechanical recycling is an environmentally advantageous method comparing to chemical recycling of textiles, in which the idea is to recycle textile fabric back into fibers without the use of chemicals, and therefore also minimize the usage of fresh water and energy. Existing mechanical recycling methods often involve cutting or tearing the textile.

Different arrangements for recycling textile cloth are disclosed in

CN104711707 A relates to a device and a method for unweaving a textile piece into yarns comprising a set of driving rollers and unweaving rollers, where one layer of textile at a time is fed into the device, and wherein the shorter fibers are parallel to the feeding direction.

CN107142561 A relates to a device for separating and recycling non-twist woven fabric, comprising a roller-type separating device together with a comb needle and a comb row which is inserted into the fabric to separate it and avoid damaging the fibers.

CN106149103 A relates to a system and a method for opening hard wastes of bunchy staple fiber yarns into fibers comprising a feeding device and a rotating clamping device, where the fiber yarns are fed through the feeding device into the rotating clamping device holding the free ends of the fiber yarns between two brush rollers which separates the fibers.

Hence, there is a wish to provide alternatives to the construction and design of mechanical recycling methods. More specifically, there is a need for improving the recycling methods such that the fiber quality is maintained and for improving mechanical recycling arrangements which may be utilized in the textile industry.

SUMMARY OF THE INVENTION

The inventors have come to the insight that using mechanical recycling methods may be of vital importance for the future textile industry. Especially using mechanical recycling methods that does not damage the fiber quality to the same extent as solutions from the prior art. As mentioned above, mechanical recycling methods often include cutting or tearing the textile, causing damages to the original fiber length and overall quality. Therefore, it is an object of at least some of the embodiments of the present invention to overcome, or at least alleviate, the above-mentioned drawbacks. In particular, it is an object to provide alternative arrangements and methods for mechanical recycling in order to maintain the fiber length and quality, to improve recycling efficiency and making the recovered fibers easier to reuse. This and other objects are achieved by providing an arrangement and a method for separating a woven textile having the features in the independent claims. Preferred embodiments are defined in the dependent claims.

By the term "woven textile" is here meant any textile that is formed by weaving. A woven textile is constructed with two threads, arranged perpendicular to each other. When the textile is woven, one of the threads is extending along the length direction, and is referred to as warp. The other thread is extending in a direction transverse to the length direction, and is referred to as weft. Further, woven textile usually frays at the edges.

By the term "separating" is here meant to separate the textile fibers from woven textile, the warp and the weft, without cutting or tearing the woven textile, to maintain the fiber length to as great extent as possible. The separating procedure includes separating the warp and weft into threads, unspinning the threads, and brushing off textile fibers from the threads. The woven textile is separated into recovered fibers and textile residual. In order to reuse the recovered fibers, they need to be spun again into threads, that can then be woven or knitted into new textile. It takes a plurality of recovered fibers to spin one thread.

By the term "recovered fiber" is here meant the textile fiber that has been separated from the woven textile. The recovered fiber can be either a textile fiber coming from the warp or the weft. It is the smallest component out of the mentioned threads, warp, weft and woven textile.

According to a first aspect of the invention, there is provided an arrangement for separating a woven textile into recovered fibers and textile residual. The arrangement comprises a feeding means configured to feed the woven textile along a feeding direction L. Further, a separating unit comprising a feeding plate and a brush roller. The brush roller comprises a plurality of bristles rotatably arranged around an axis of rotation substantially transverse to the feeding direction L. The brush roller is arranged such that a separating area is defined between bristles of the roller and the feeding plate. The woven textile is separated into recovered fibers and textile residual in the separating area by rotation of the brush roller. Further, a fiber sorting device is arranged downstream the separating unit. The sorting device comprises a fiber collecting device configured to collect the recovered fibers, and a residual chamber configured to collect the textile residual. Further, the arrangement comprises a control unit configured to control an operation of the feeding means, the separating unit and the fiber sorting device. Further, the arrangement comprises a sensor. The sensor is arranged to monitor and determine the position of a downstream free end of the woven textile being fed to the separating unit. The control unit is configured to control the feeding means such that the free end of the woven textile is maintained within the separating area. The control unit controls the feeding means based on information from the sensor regarding the position of the downstream free end of the woven textile.

In a second aspect of the invention, there is provided a method for separating a woven textile, comprising the steps of:

a. inserting a woven textile into the feeding means;
b. separating the woven textile in the separating unit into recovered fibers and textile residual;
c. sorting the recovered fibers and textile residual in the fiber separation device;
d. collecting the recovered fibers from the fiber collecting chamber.

Thus, there is provided an arrangement and a method for separating a woven textile. It will be appreciated that the current inventive concept, with the arrangement and the method comprising the steps above, offer a sustainable way of separating woven textiles. The present arrangement and method have many advantages, a first advantage being that a woven textile can efficiently be separated into recovered fibers and textile residual. This ensures that recovered fibers from a woven textile can be reused in another textile in a later point in time. This further ensures a more environmentally friendly and energy efficient method for recycling woven textiles. The feeding means enables the woven textile to be fed into the separating unit along the feeding direction L. Therefore, a second advantage is that the woven textile is fed into the separating unit in a controlled way, as this will facilitate the operability of the arrangement. The separating unit enables the free end of the woven textile to be separated by rotating of the brush roller. The bristles on the brush roller are inserted into the woven textile and separates the woven textile into recovered fibers and textile residual by brushing off fibers from the warp and the weft. The feeding plate supports the woven textile. For example, the fibers can break or become tangled if the brush roller is inserted into the woven textile too far from the free end. The control unit controls that the free end of the woven textile is maintained within the separating area. Thus, a third advantage is that the feeding is controlled such that the brush roller can grip the woven textile in an optimal way at the end of the woven textile which is frayed. This further enables separation of the woven textile, with less tangling of the fibers, since the brush roller is brushing the woven textile at the frayed end. Another advantage coming from this is that the recovered fiber length is increased. This ensures easier reuse of the recovered fibers, higher quality of the fiber, increased recovered fiber length and more cost-effective recycling, as well as providing more ways in which the recovered fiber can be reused. The increased length of the fibers also enable upcycling of the woven textile, which means that the textile fibers can be reused to create a product equivalent to the one it was recycled from. Maintaining a certain fiber length is important in order to enable reuse of the fibers. Further, the fiber sorting device separates the recovered fibers from the textile residual. Therefore, an advantage is that the recovered fibers are easily collected for reuse, without the need for manual sorting. Further, the control unit enables an operation of the arrangement or method to be controlled. Therefore an advantage is that the operation of the arrangement or method requires less manual interference, which makes the arrangement robust and easy to use.

According to an embodiment of the present invention, the control unit is configured to control the feeding means to rotate in a reverse direction if the free end of the woven textile is fed past the separating area along the feeding direction L. The control unit controls the feeding means based on information from the sensor. The present embodiment is advantageous as it minimizes the risk of wasting textile material due to the woven textile being fed to far and/or too fast through the separating unit.

According to an embodiment of the present invention, the separating area further comprises a cutting means in connection with the sensor and arranged downstream the brush roller, said cutting means is configured to cut the woven textile if the free end of the woven textile is tangled in the feeding direction L. The present embodiment is advantageous in that the separating process can continue in the case where the woven textile is tangled without having to restart the arrangement or stop the process. If the woven textile is tangled during separating, that tangled piece can be cut off and the separating process can continue with a fresh piece of woven textile. This further minimizes the amount of disposed textile since the entire piece of textile does not have to be disposed, only the tangled part. Another advantage of this embodiment is that it enables a more automated process, with less manual interference since the cutting means are automated and in connection with the sensor. Further, this decreases changeover time as well as minimizes the risk of injuries.

According to an embodiment of the present invention, the arrangement further comprises an input sensor. The input sensor is arranged to monitor an angle $\beta$, between the feeding direction L and a weft direction of the woven textile upon insertion into the feeding means. The control unit is configured to, based on information from the input sensor, determine if the angle $\beta$, is within an acceptable range. The control unit sends an alert if the angle is not within the range. The present embodiment is advantageous as the separating of the woven textile will be more efficient. Further, it sends an alert if the angle is not within the range, which minimizes the need for manual checking. Further, it is appreciated that the embodiment is advantageous in that the efficiency of the arrangement is increased.

According to an embodiment of the present invention, the input sensor is configured to detect the orientation of the weft and/or warp of the woven textile to monitor the orientation of the woven textile. The present embodiment is advantageous in that the need for manual interference is minimized, and it will be appreciated that this also decreases the risk of human errors.

According to an embodiment of the present invention, the feeding means comprises at least two rollers each rotatably arranged around an axis of rotation substantially transverse to the feeding direction L. The at least two rollers are arranged such that the woven textile is lead along a curved path. The present embodiment is advantageous as the friction between the feeding means and the woven textile keeps the woven textile from sliding uncontrollably through the feeding means. It will be appreciated that the present embodiment increases control of the arrangement and specifically the feeding of the woven textile.

According to an embodiment of the present invention, the at least one of the at least two rollers comprises a plurality of bristles, nobs or a surface material arranged to increase a friction between the at least two rollers and the woven textile. The present embodiment is advantageous in that the friction between the woven textile and the feeding means is increased. It will be appreciated that the present embodiment will further increase control of the arrangement and minimize the risk of the woven textile being fed uncontrollably through the feeding means.

According to an embodiment of the present invention, the at least two rollers are arranged on opposite sides of the woven textile. The present embodiment is advantageous in that the friction surface between the woven textile and the feeding means increases, which may increase the controllability.

According to an embodiment of the present invention, the arrangement further comprises a textile orientation means arranged upstream the feeding means. The textile orientation means are configured to orient the woven textile upon insertion into the feeding means. The present embodiment is advantageous in that it enables the feeding process to be automated. This increases the precision of the arrangement, and the probability that the angle β is within an acceptable range. The present embodiment is further advantageous in that the arrangement is more eligible for industrial applications.

According to an exemplifying embodiment, the textile orientation means may include a feeding tray and a lift. The woven textile may then be placed on the feeding tray which is then transferred onto the lift. The feeding tray may for example be placed on a conveyor belt in order to transfer it to the lift. In another example, the feeding tray may be transferred onto the lift by a user. In yet another example, the feeding tray may be placed on a planar surface and placed or pushed onto the lift by a pushing force from a mechanical shaft controlled by a motor. According to another exemplifying embodiment, the textile orientation means may include a robot and a type of container where the woven textile is placed. The robot may then retrieve woven textile or woven textiles from the container, by for example grabbing it with a robotic arm, and orient the woven textile or woven textiles such that they are fed into the feeding means having an angle β within the desired range. The robot may include a sensor configured to monitor the angle β such that the woven textile or woven textiles can be fed into the feeding means with the angle β in an acceptable range. In one example, the robot may also include the input sensor. The robot may be an independent part of the arrangement, or integrated with the arrangement.

According to an embodiment of the present invention, the length of the separating area along the feeding direction L corresponds to an angle α of rotation of the brush roller around the rotational axis. The angle α is within the range of 3°-15° and preferably within the range of 4°-12°. The angle α represents a contact surface between the woven textile and the brush roller, and the range 3°-15° determines an optimal size of the contact surface for separating of the woven textile. If the contact surface is too small, the separating process will become inefficient. If the contact surface is too big, a bigger portion of the bristles on the brush roller will be inserted into the woven textile, and increase the risk of tangling it. Therefore, the present embodiment is advantageous in that the size of the contact surface is optimized.

According to an embodiment of the present invention, the bristles on the brush roller are formed of a metal material, a plastic material, natural fibers or a mix of the mentioned materials. The present embodiment is advantageous in that it may increase durability of the brush roller, which decreases the wear. It will be appreciated that the present embodiment will also make it easier to insert the bristles into the woven textile.

According to an embodiment of the present invention, the feeding plate is formed of a hard material and comprises a smooth surface. The present embodiment is advantageous in that the friction between the brush roller and the feeding plate will decrease. It will be appreciated that the present embodiment will also increase the efficiency of the separating unit.

According to an embodiment of the present invention, at least a section of the feeding plate comprises a transparent material, and wherein the sensor is arranged below the transparent section of the feeding plate. The present embodiment is advantageous in that it prevents dirt, dust or textile particles from getting stuck on the sensor, and impairing the ability to monitor and determine the position of a downstream free end of the woven textile.

According to an embodiment of the present invention, the arrangement further comprises a user interface connected to the control unit. The present embodiment is advantageous as it will increase the user-friendliness in that the separating process may be tailor-made according to the user's preferences. Accurate information about the woven textile may be supplied by the user, further increasing the efficiency of the arrangement.

According to an embodiment of the present invention, the distance between the brush roller and the feeding plate is adjustable. The control unit is configured to adjust the distance between the brush roller and the feeding plate in the separating area. The control unit adjusts the distance based on an input via the user interface regarding a number of layers of woven textile being fed into the arrangement and/or information regarding a characteristic of the woven textile. The present embodiment is advantageous in that the arrangement is versatile and may work for all woven textiles. It will be appreciated that the present embodiment further increases the usability of the arrangement.

According to an exemplifying embodiment, the feeding plate may be inclined and have a downwards inclination in relation to the brush roller. This increases the distance between the brush roller and the feeding plate downstream of the brush roller, enabling the cutting means to be placed closer to the brush roller.

According to an exemplifying embodiment, the woven textile may be fed to the brush roller with an angle, i.e. not being horizontally beneath the bristles of the brush roller. This is advantageous in that the bristles of the brush roller may get a better grip of the woven textile or layers of woven textiles being fed into the brush roller. A better grip between the brush roller and the woven textile is advantageous since the risk of woven textile being tangled along the contact surface of the brush roller and the free end of the woven textile is reduced, meaning that the amount of textile residual due to entanglement may be reduced.

According to an embodiment of the present invention, the brush roller is resiliently supported and forced towards the feeding plate with a predetermined force. The force is adapted to the number of layers of woven textile being fed into the arrangement and/or information regarding a characteristic of the woven textile. The present embodiment is advantageous in that can unweave several layers of woven textile at a time. It will be appreciated that the present embodiment further increases the efficiency of the arrangement.

According to an embodiment of the present invention, the fiber sorting device further comprises suction means arranged such that the recovered fibers are separated from the textile residual and collected by the fiber collecting device. The present embodiment is advantageous in that the recovered fibers has a smaller weight than the textile residual, and the suction means provide an easy way of collecting the recovered fibers while avoiding the textile residual.

According to an exemplifying embodiment, the fiber sorting device may further comprise a deionization chamber configured to deionize the recovered fibers and textile residual. The deionization may detangle recovered fibers and textile residual that have been tangled due to ionization. The deionization happening in the deionization chamber may further keep the recovered fibers apart. This is advantageous in that it facilitates the sorting of the recovered fibers and textile residual for the fiber collecting device.

According to an embodiment of the present invention, the control unit is configured to adapt the operation of the suction means such that the recovered fibers are separated from the textile residual. The control unit adapts the operation of the suction means based on input via the user interface regarding a characteristic of the woven textile being fed into the arrangement. The present embodiment is advantageous in that it can collect recovered fibers from different types of woven textiles, and minimize the risk of collecting textile residual.

According to an embodiment of the present invention, the residual chamber further comprises circulating means arranged to circulate the textile residual in the residual chamber, such that recovered fibers mixed with the textile residual in the residual chamber are released and transferred to the fiber collecting device. The present embodiment is advantageous in that recovered fibers that may get stuck on a textile residual can circulate up towards the fiber collecting device again and be collected by the desired means. It will be appreciated that the present embodiment offers minimizes the amount of incorrectly sorted recovered fibers.

According to an embodiment of the present invention, the fiber collecting device comprises a fiber collecting chamber and an air withdrawing means. The air withdrawing means is configured to generate a flow of air through the fiber collecting device to direct the recovered fibers to the fiber collecting chamber. The present embodiment is advantageous in that the recovered fibers can be packed in an efficient way. It will be appreciated that the present embodiment may further enable packing a larger volume of recovered fibers per unit volume.

According to an embodiment of the present invention, the method further comprises the step of;

Setting, via the user interface, one or more, parameters regarding the woven textile required by the control unit to control an operation of the arrangement. The present embodiment is advantageous in that it enables customization of the operation, which makes the arrangement more user-friendly. With parameters set in the user interface, the operation of the arrangement can be adapted to suit different types of woven textile, which makes the arrangement versatile.

According to an embodiment of the present invention, further comprising the step a0 to be performed before step a, step a0 including;

orienting, using the textile orienting means according to claim 9 and the control unit, the woven textile in the acceptable range of the angle β. The present embodiment is advantageous in that it enables automation of the feeding process, and increases scalability. The orientation of the woven textile decreases the risk of the woven textile being outside the acceptable range of the angle β.

BRIEF DESCRIPTION OF THE DRAWINGS

The above, as well as additional objects, features and advantages of the present invention, will be better understood through the following illustrative and non-limiting detailed description of embodiments of the present invention. Reference will be made to the appended drawings, on which.

All the figures are schematic, generally not to scale, and generally only show parts which are necessary in order to elucidate the invention, whereas other parts may be omitted or merely suggested.

DETAILED DESCRIPTION

The present aspects will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspects to the skilled person.

Figure 1A:
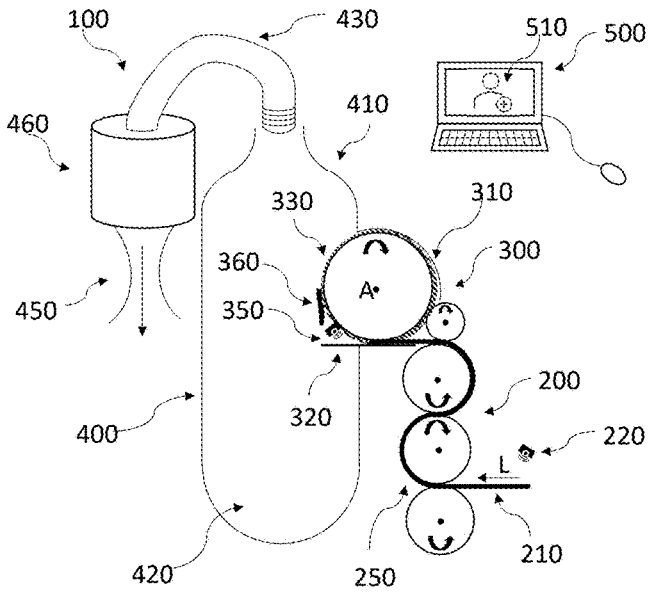
FIG. 1*a* is a schematic view of an arrangement for separating a woven textile according to the invention.

With reference to FIG. 1*a*, an arrangement 100 for separating a woven textile 210 according to the invention is schematically described. The arrangement 100 comprises feeding means 200, configured to feed the woven textile 210 along a feeding direction L through the arrangement. The feeding means 200 includes four rollers 250, each rotatably arranged around an axis of rotation substantially transverse to the feeding direction L. The friction between the woven textile 210 and rollers 250 increases with the number of rollers 250. This will feed the woven textile 250 in a more controlled way through the feeding means 200. Another effect from the increased friction is that larger pieces of woven textile can be held and fed in a controlled manner by the feeding means 200. There may also be embodiments that have three rollers 250. Another embodiment may have five or more rollers 250. It is clear that other embodiments are possible where the rollers 250 may be any number of rollers greater than or equal to two. In one embodiment, the rollers 250 are connected to and steered by an electrical motor. The electrical motor may have a gear box that could adapt the velocity of the rollers 250.

The woven textile 210 is led along a curved path along the feeding direction L via the rollers 250. The curved path is a type of S-shaped path, so as to lead the woven textile 210 in a controlled way through the feeding means 200 and increase the contact area between the textile and the surfaces of the rollers to increase the friction between the textile and rollers. Furthermore, the curved path ensures that the fabric will be forced towards the surface of the rollers. It is clear that in other embodiments, the curved path may have another shape. The rollers 250 are arranged on opposite sides of the woven textile 210, so as to hold the woven textile 210 steady during feeding.

In an advantageous embodiment, like in the examples of attached figures, the arrangement 100 further includes an input sensor 220, configured to monitor and determine the angular orientation of the woven textile 210 in relation to the feeding direction L, i.e. an angle β, in order to ensure that the orientation of the woven textile is within the acceptable range to ensure an efficient separation of fibers from the woven textile.

The woven textile 210 is fed through the feeding means to the separating unit 300 arranged downstream the rollers of the feeding means. The separating unit 300 is preferably arranged close to the downstream roller of the feeding means to ensure that the textile reaches the separating unit 300 in the intended position. The separating unit 300 comprises a brush roller 310 and a feeding plate 320. The brush roller 310 is rotatably arranged around an axis of rotation A substantially transverse to the feeding direction L, and intended to rotate in a direction corresponding to the feeding direction of the fabric such that the fabric is tensioned by the brush roller 310 that also assist the desired feeding of the fabric along direction L. The brush roller has a plurality of bristles 330 extending from a core shaped as a cylinder with circular cross-section coaxial to the brush roller 210 axis of rotation. The separating unit 300 further comprises the feeding plate 320 intended to support the woven textile 210. The brush roller 310 is arranged such that a separating area 340 is defined between the outer ends of the bristles 330 of the brush roller 310 and the feeding plate. During operation, the brush roller 310 is rotated by a suitable engine to unweave the woven textile 210 arranged in the separation area 340.

In one embodiment, the feeding plate 320 has a smooth surface, so as to decrease friction between the bristles 330 and the feeding plate 320. In an advantageous embodiment, the feeding plate 320 is made of a material that cannot ignite spontaneously. The woven textile 210 lies on the feeding plate 320 during separating.

A sensor 350 is arranged in the separating unit 300 to monitor and determine the position of a downstream free end of the woven textile 210 fed to the separating unit 300. In one embodiment, the sensor 350 is placed downstream the brush roller 310. In another embodiment, shown in FIG. 1*a*, the sensor 350 is placed on one, or both, sides of the brush roller 310, in the length direction of rotational axis A.

In another embodiment, the feeding plate 320 is made of a transparent material and the sensor 350 is placed below the feeding plate 320. The sensor can then monitor the woven textile 210 through the transparent material. The sensor 350 is thus protected from dust, textile material or other type of dirt which can end up in the separating unit 300. It is clear that other positions of the sensor 350 are also possible.

The separating unit 300 further comprises cutting means 360 arranged in connection to the sensor 350 downstream the brush roller 310. The cutting means 360 are configured to cut the woven textile if the free end of the woven textile is tangled along the feeding direction L, i.e. if the separation of woven textile not has been successful in the separation area, the cutting means could be used to remove residue material extending downstream the separation area. The cutting means 360 is operated and controlled by the control unit 500 that acts on information from the sensor 350. The cutting means 360 is intended to be placed as the most downstream component in the separating unit 300, so that the cut woven textile 210 will continue into the fiber sorting device 400. The cutting means 360 is preferably mounted close to the brush roller 310.

In one embodiment, the feeding plate 320 may be inclined and have a downwards inclination in relation to the brush roller 310. This increases the distance between the brush roller 310 and the feeding plate 320 downstream the brush roller 310, enabling the cutting means 360 to be placed closer to the brush roller 310. In one embodiment, the cutting means may be a knife or a pair of scissors. It is understood that the cutting means 360 may be any type of sharp blade.

Downstream the separating unit 300 a fiber sorting device 400 is arranged. The sorting device 400 comprises a fiber collecting device 410 and a residual chamber 420. The fiber sorting device 400 is partially enclosing the separating unit 300 to collect as much fibers and residue material as possible. For example, the fiber sorting device 400 may be a box, a cylinder or other type of container. In a preferred embodiment, the edges of the fiber sorting device 400 may be rounded in order to prevent recovered fibers 110 or textile residual 120 from getting stuck. The fiber collecting device 410 is configured to collect the recovered fibers 110. The fiber collecting device 410 is partly enclosing the separating unit 300. In one embodiment, shown in FIG. 1*a*, the fiber collecting chamber 410 and the residual chamber 420 are included in the same unit, which is partly enclosing the separating unit 300. In another embodiment, the fiber collecting device 410 and the residual chamber 420 are embodied as separate units. The recovered fibers 110 and the textile residual 120 coming out from the separating unit 300 are already in the fiber sorting device 400 since the separating unit 300 is partially enclosed by the fiber sorting device 400. The fiber collecting device 410 has an opening configured to hold suction means 430 arranged to generate a flow of air through the sorting device to divide the lighter recovered fibers from the heavier textile residual. The suction means 430 enables collection of the recovered fibers 110 by a suction force. The suction force is intended to transfer the recovered fibers 110 from the separating unit 300 to the fiber collecting device 410. In one embodiment, shown in FIG. 1*a*, the fiber collecting device 410 is arranged above the separating unit 300. The residual chamber 420 is arranged below the separating unit 300. The textile residual 120 is intended to fall down into the residual chamber 420 by force of gravity. In an advantageous embodiment, as shown in FIG. 1*a*, the fiber collecting device 400 further comprises an air withdrawing means 450 and a fiber collecting chamber 460. The air withdrawing means 450 is configured to generate a flow of air through the fiber collecting device 410 to direct the recovered fibers 110 to the fiber collecting chamber 460. The fiber collecting chamber 460 is intended to be the final destination of the recovered fibers 110. From the fiber collecting chamber 460, the recovered fibers 110 can for example be packed and sent for reuse. The air withdrawing means 450 is intended to remove the air in the fiber collecting chamber 460 so as to effectively compress the volume in the collecting chamber to store mainly recovered fibers 110 and not excess air. In one embodiment, the air withdrawing means may be a vacuum pump or a suction fan. It is clear that other types of air withdrawing means are also possible.

The arrangement further comprises a control unit 500. The control unit 500 is configured to control the operation of the feeding means 200, the separating unit 300 and the fiber sorting device 400. A user interface 510 is connected to the control unit 500. In one embodiment, the control unit 500 may be an embedded system. In another embodiment, the control unit 500 may be a computer. In another embodiment, the control unit 500 may be a user. It is clear that other embodiments are possible where the control unit 500 is another type of control units 500. In one embodiment, the control unit 500 is connected to the rollers 250, and able to adapt the velocity of the rollers 250.

Figure 1B:
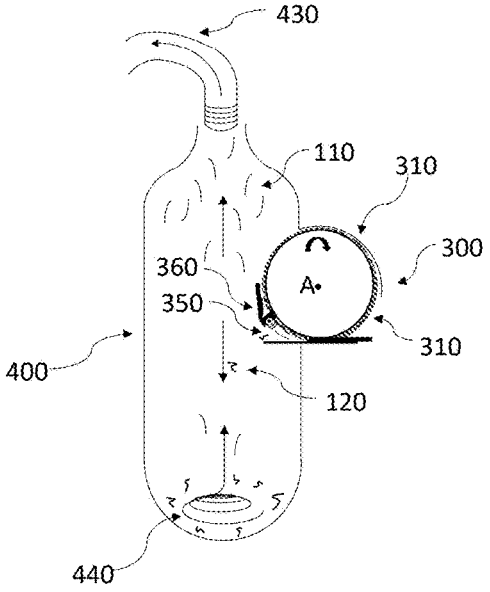
FIG. 1*b* is a schematic view, with some parts removed for clarity, of the separating unit and the fiber sorting device.

With reference to FIG. 1*b*, the fiber sorting device 400 according to the present invention is schematically described. The woven textile 210 is separated into recovered fibers 110 and textile residual 120 by the separating unit 300. In one embodiment, the length of the recovered fibers are between 12 mm-30 mm. The fiber collecting device 410 is configured to collect the recovered fibers 110. The residual chamber 420 is configured to collect the textile residual 120. The fiber sorting device 400 further comprises a suction means 430 arranged such that the recovered fibers 110 are separated from the textile residual 120 and collected in the fiber collecting device 410. For example, the recovered fibers 110 may have different weight depending on the characteristics of woven textile 210. Therefore, in order to separate the recovered fibers 110 from textile residual 120, the operation of the suction means 430 is adapted to efficiently separate them. According to one embodiment, the textile residual 120 has a larger weight than the recovered fibers 110. Therefore, the textile residual 120 will not be affected by the suction means 430 and therefore no collected by the fiber collecting device 410. Instead, the textile residual 120 will fall down into the residual chamber 420. The recovered fibers 110 will be affected by the suction means 430 and drawn towards the fiber collecting device 410, where they will be collected. The suction means 430 may for example be a vacuum pump. In another embodiment, the suction means may be a type of suction fan drawing the recovered fibers 110 from the fiber sorting device 400 to the fiber collecting device 410. In another embodiment, the suction means 430 may be a dust separator. In other embodiments, the suction means 430 may be of another type than mentioned here.

The residual chamber 420 further comprises circulating means 440. The circulating means 440 are arranged to circulate the textile residual 120 in the residual chamber 420 to release and transfer recovered fibers 110 mixed with textile residual 120 to the fiber collecting device 410. For example, a textile residual 120 may be a thread, on which a recovered fiber 110 may be stuck. Since the textile residual 120 is collected in the residual chamber 420, the recovered fiber 110 stuck on the thread may be incorrectly sorted into the residual chamber 420. The circulating means enables the recovered fiber 110 to be separated from the thread and circulate upwards from the residual chamber 420 to the fiber collecting device 410, so as to collect it in the intended place. The circulating means 440 are intended to circulate the air in the residual chamber 420 so as to circulate and transfer the textile residual 120 and recovered fibers 110. The edges of the fiber sorting device 400 are preferably rounded to enhance the circulation of the air and textile residual 120 and recovered fibers 110. The textile residual 120 that circulates upwards will fall down into the residual chamber 420 again since the weight of the textile residual is too heavy to be picked up by the suction means 430. In one embodiment, the circulating means 440 may be a type of fan. In another embodiment, the circulating means 440 may be a type of air mover. It is clear that other types of circulating means 440 are also possible.

Figure 2:
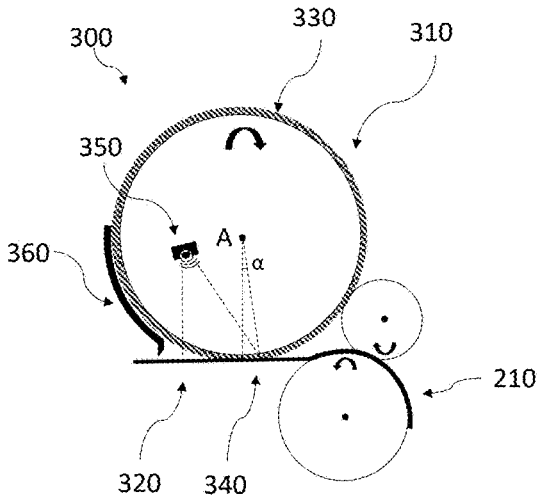
FIG. 2 is a detailed view of the separating unit.

With reference to FIG. 2, the separating unit 300 according to the present invention is schematically described. The separating unit 300 comprises a separating area 340 defined between the bristles 330 of the brush roller 310 and the feeding plate 320. The bristles 330 on the brush roller 310 are inserted in the woven textile close to the free end of the woven textile 210 in the separating area 340. Rotation of the brush roller 310 enables the bristles 330 to unweave the woven textile 210 by brushing so as to separate the woven textile into recovered fibers 110 and textile residual 120. The feeding plate 320 is supporting the woven textile 210.

In an advantageous embodiment, the length of the separating area 340 along the feeding direction L corresponds to an angle $\alpha$ of rotation of the brush roller 310 around the rotational axis A. In one embodiment, the angle $\alpha$ is in the range 3°-15°. In an advantageous embodiment, the angle $\alpha$ is within the range 4°-12°. The length of the separating area 340 is important for avoiding entangling of the woven textile 210. If the angle $\alpha$ exceeds the preferred range, and a larger portion of the free end of the textile woven 210 is engaged with the bristles 330 of the brush roller 310, the risk of the woven textile 210 getting tangled increases.

In a preferred embodiment, the bristles 330 are substantially perpendicular to the woven textile 210 when the woven textile 210 is within the separating area 340. In one embodiment, the range of the angle $\alpha$ covers the area where the woven textile 210 is substantially perpendicular to the bristles 330. Therefore, the bristles 330 may be inserted into the woven textile 210 before they are substantially perpendicular to the woven textile 210, still within the range of angle $\alpha$. In another embodiment, the separating area 340 starts at an angle $\alpha$ before the area where the woven textile 210 is perpendicular to the bristles 330 and ends at an angle $\alpha$ after this area.

In one embodiment, the bristles 330 on the brush roller 310 are formed of a metal material. In another embodiment, the bristles 330 are formed of a plastic material. In another embodiment, the bristles 330 are formed of natural fibers. In another embodiment, the bristles 330 are formed of a mix of the mentioned materials. For example, the bristles 330 may be formed by a material that is a mixture between plastic and natural fibers. It is clear that other types materials or mix of materials are also possible.

The brush roller 310 is rotatably arranged around an axis of rotation A substantially transverse to the feeding direction L. In one embodiment, the brush roller 310 may rotate in a clockwise direction to unweave the woven textile 210. In another embodiment, the brush roller may rotate in a counterclockwise direction to unweave the woven textile 210.

In an advantageous embodiment, the feeding plate 320 is formed of a hard material. In another advantageous embodiment, the feeding plate 320 comprises a smooth surface. For example, the feeding plate 320 can be formed of a plastic material. In another embodiment, the feeding plate 320 could for example be formed of a metal material. It is clear that other types of material are also possible.

In an advantageous embodiment, the distance between the brush roller 310 and the feeding plate 320 is adjustable. This enables woven textiles 210 with different characteristics, i.e thickness, to be separated into recovered fibers 110 and textile residual 120. It also enables a plurality of layers of woven textile 210 to be separated simultaneously in the arrangement into recovered fibers 110 and textile residual 120. Layers of woven textile 210 can be stacked on top of each other and fed into the feeding means 300. The distance between the brush roller 310 and the feeding plate 320 may for example then be increased. If several layers are separated simultaneously all layers should have substantially the same orientation of the warp and weft.

The separating unit 300 further comprises cutting means 360. The cutting means 360 are configured to cut the woven textile 210 if the free end of the woven textile 210 is tangled along the feeding direction L, i.e. the separation of the textile not has been completed within the separating area. In a preferred embodiment, the cutting means 360 are arranged above the woven textile 210. When cutting the woven textile 210, the cutting means 360 is lowered into the woven textile 210 to cut it. In one embodiment, the operation of the cutting means 360 is automated. The cutting means 360 are connected to the control unit 500. The sensor 350 sends information about the position of the woven textile 210, and the control unit 500 controls an operation of the cutting means 360 so as to cut the woven textile 210. In another embodiment, the cutting means 360 are manually controlled. For example, a user may manually cut the woven textile 210 with the cutting means 360. In one embodiment, the cutting means 360 may be a sharp blade. In another embodiment, the cutting means 360 may be a pair of scissors.

In one embodiment, the sensor 350 may be a proximity sensor. In another embodiment, the sensor 350 may be an ultrasonic sensor. In another embodiment, the sensor 350 may be a light sensor. In another embodiment, the sensor 350 may be an optical sensor. In another embodiment, the sensor 350 may be a user manually checking the position of the free end of the woven textile 210. It is clear that the use of other types of sensors 350 are also possible. The sensor 350 is connected to the control unit 500. The sensor 350 may send information to the control unit 500. The control unit 500 may control an operation of the separating unit 300 based on the information received from the sensor 350.

Figure 3:
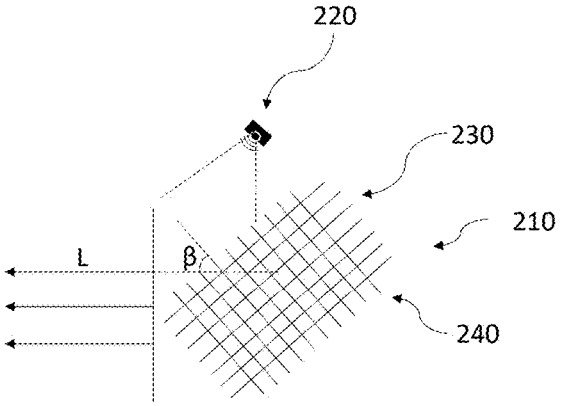
FIG. 3 is a top view of the woven textile in relation to the feeding direction L.

With reference to FIG. 3, a top view of the woven textile 210 in relation to the feeding direction L is illustrated according to the present invention. The woven textile 210 comprises a warp 230 and a weft 240. The arrangement 100 further comprises an input sensor 220. The input sensor 220 is arranged to monitor an angle β defined between the feeding direction L and the orientation of the woven textile 210. In one embodiment, the angle β may be defined between the feeding direction L and the warp 230. In another embodiment, the angle β may be defined between the feeding direction L and the weft 240.

The input sensor 220 is configured to detect and monitor the orientation of the warp 230 and the weft 240 of the woven textile 210. In one embodiment, the input sensor 220 may be a proximity sensor. In another embodiment, the input sensor 220 may be an optical sensor. In another embodiment, the input sensor 220 may be a user manually checking the orientation of the woven textile 210. The input sensor 220 is connected to the control unit 500 and may send information to the control unit 500. In one embodiment, the control unit 500 sends an alert based on the information received from the input sensor 220. In one embodiment, the alert may be a warning to warn that the angle β is not within an acceptable range. In another embodiment, the alert may be a signal to confirm that the angle β is within an acceptable range. In another embodiment, the alert may be both a warning and a signal.

The brush roller 310 can unweave the woven textile 210 in an effective way when the warp 230 and weft 240 is arranged at an angle β during insertion into the feeding means 200. When the angle β is zero, the warp 230 or weft 240 is parallel to the feeding direction L. In a preferred embodiment, the angle β is 45 degrees. Both the warp 230 and the weft 240 may be used to measure the angle β. In another embodiment, the angle β may be 35-55 degrees. In a preferred embodiment, the angle β is different from zero.

With reference to FIG. **4*a*-4*i*, schematic views of the feeding means according to the present invention are shown. In one embodiment, at least one of the rollers 250 comprises a plurality of bristles, nobs or surface material 260 arranged to increase a friction between the rollers 250 and the woven textile 210. In one embodiment, at least one of the rollers 250 comprises a plurality of bristles 260. In another embodiment, at least one of the rollers 250 comprises a plurality of nobs 260. In another embodiment, at least one of the rollers 250 comprises a surface material 260 arranged to increase a friction between the rollers 250 and the woven textile 210. In one embodiment, at least one of the rollers 250 comprises cogs 270**.

Figure 4A:
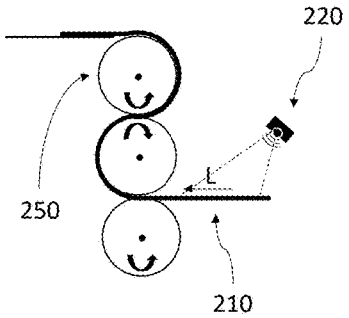
FIG. 4*a*-4*i* are schematic views of the feeding means.
Figure 4B:
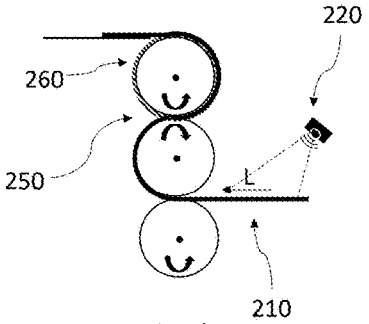
Figure 4C:
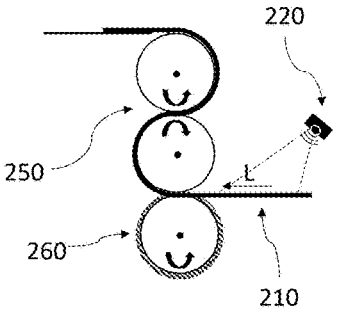
Figure 4D:
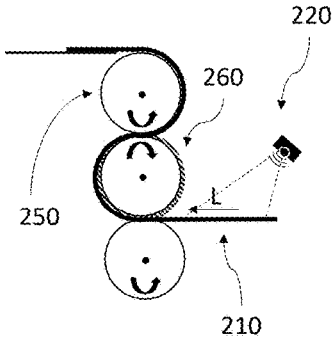
Figure 4E:
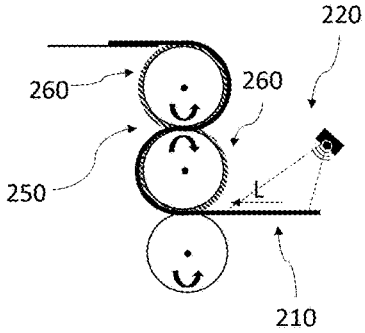
Figure 4F:
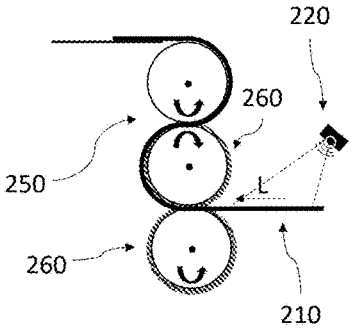
Figure 4G:
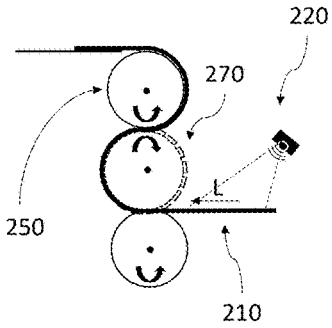
Figure 4H:
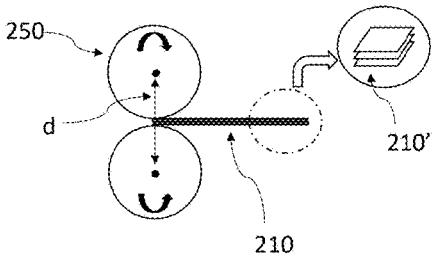

FIG. **4*a*-4*i* shows examples of possible embodiments of the rollers 250. For example, as seen in FIG. 4*a*, none of the rollers 250 comprises a plurality of bristles 260. Another example is seen in FIG. 4*b* where one of the rollers 250 comprise a plurality of bristles 260. FIG. 4*c* shows another example where one of the rollers 250 comprises a plurality of bristles 260. FIG. 4*d* also shows another example where one of the rollers 250 comprises a plurality of bristles 260. FIG. 4*e* shows an embodiment where two of the rollers 250 comprises a plurality of bristles 260. FIG. 4*f* shows another embodiment where two of the rollers 250 comprises a plurality of bristles 260. FIG. 4*g* shows another embodiment where one of the rollers 250 comprises cogs 270. It is understood that these embodiments are not limiting and that other possible embodiments where the rollers 250 comprises a plurality of bristles, nobs or a surface material 260 arranged to increase a friction between the rollers 250 and the woven textile 210** exists.

The bristles, nobs or surface material 260 arranged to increase a friction between the rollers 250 and the woven textile 210 enables better control of the feeding means 200. When the friction between the rollers 250 and the woven textile 210 increases, larger pieces of woven textile 210 can be fed to the arrangement 100 since the friction will make it harder for the woven textile 210 to slip on the rollers 250.

The cogs 270 are arranged to hold the woven textile 210 while it is fed through the arrangement 100. The cogs 270 are configured to transfer torque and speed between the rollers 250. In one embodiment where two or more rollers 250 comprises cogs 270, the cogs 270 mesh with each other.

In another embodiment, the rollers 250 comprising cogs 270 are cogwheels.

FIG. **4*h* shows another embodiment where the distance d between the rollers 250 is adjustable. In one embodiment, the distance d is adjusted based on the number of layers of woven textile 210' that is fed into the arrangement 100. In one embodiment, the number of layers of woven textile 210' to feed into the arrangement 100 is three. The distance d is then adjusted so as to fit the layers 210' and hold them not to slip uncontrollably through the feeding means 200. The distance d may be adjustable and controlled via a gear box connected to the arrangement 100. The gear box may also be connected to the control unit 500**.

Figure 4I:
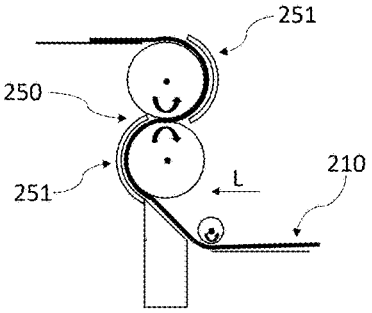

FIG. 4*i* shows another embodiment where the feeding means 200 further comprises guides 251. The guides 251 are configured to guide the woven textile 210 or the layers of woven textile 210' through the feeding means 200. The risk of the woven textile 210 falling out from the feeding means 200 is decreased by using the guides 251. The guides are arranged to partly enclose the shape of the rollers 250. The woven textile 210 is arranged between the rollers 250 and the guides 251. In one embodiment, the guides 251 may be a type of screen or a shaped plate. It is clear that the guides 251 could be any type of component arranged to guide the woven textile 210 through the feeding means 200.

Figure 5:
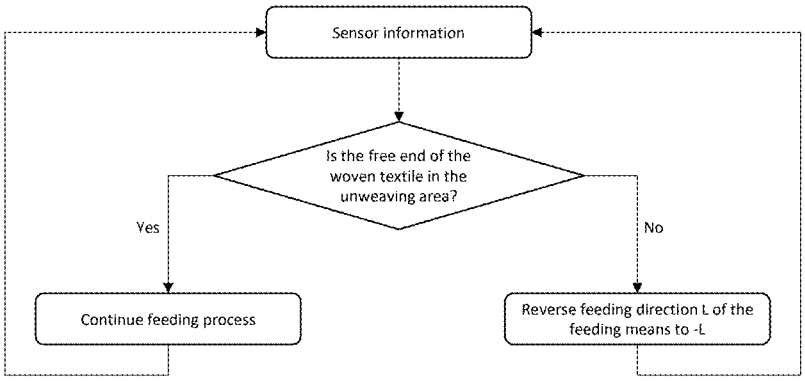
FIG. 5 is a flow chart illustrating a control unit process according to the invention.

With reference to FIG. 5, a flow chart showing a control unit 500 process according to the invention is shown. The control unit 500 receives information from the sensor 350. The information from the sensor 350 includes information about the position of the free end of the woven textile 210 in the separating unit 300. The control unit 500 will based on this information control an operation of the feeding means 300. If the sensor 350 information says that the free end of the woven textile 210 is within the separating area 340, the control unit 500 will not adapt the operation of the feeding means 300. The control unit 500 will repeat this action until a change occurs in the information from the sensor 350. If the sensor 350 information says that the free end of the woven textile 210 is not within the separating area 340, the control unit 500 will adapt the operation of the feeding means 300. The control unit 500 will repeat this action until a change occurs in the information from the sensor 350. The sensor 350 detects if the free end of the woven textile 210 is downstream the separating area 340. In a preferred embodiment, for example shown in FIG. 5, the control unit 500 will adapt the operation of the feeding means 300 to revert the rotational direction of the at least two rollers 250, if the information of the sensor 350 says that the free end of the woven textile 210 is downstream the separating area 340, so as to pull the woven textile 210 back into the separating area 340. Further, the control unit 500 will not adapt the operation of the feeding means 300, if the information of the sensor 350 says that the free end of the woven textile 210 is within the separating area 340, so as to keep the woven textile 210 in the separating area 340. In one embodiment, the sensor 350 may detect if the free end of the woven textile 210 is upstream the separating area 340. The control unit 500 will then adapt the operation of the feeding means 300 to increase the speed of the rotational movement of the at least two rollers 250, if the information of the sensor 350 says that the free end of the woven textile 210 is upstream the separating area 340, so as to pull the woven textile 210 into the separating area 340.

Figure 6:
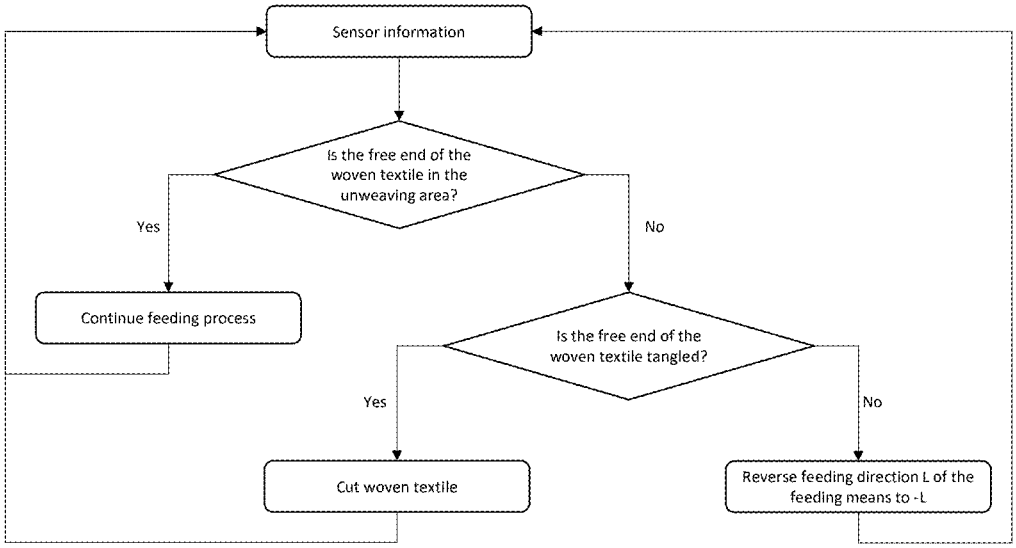
FIG. 6 is a flow chart illustrating a control unit process according to the invention.

With reference to FIG. 6, a flow chart showing a control unit 500 process according to the invention is shown. The control unit 500 receives information from the sensor 350. The information from the sensor 350 includes information about the condition of the woven textile 210. The control unit 500 will based on this information control an operation of the cutting means 360. If the sensor 350 information says that the condition of the woven textile 210 is not tangled, the control unit 500 will not adapt the operation of the cutting means 360. The control unit 500 will repeat this action until a change occurs in the information from the sensor 350. If the sensor 350 information says that the condition of the woven textile 210 is tangled, the control unit 500 will adapt the operation of the cutting means 360. The control unit 500 will repeat this action until a change occurs in the information from the sensor 350. The sensor 350 detects if the free end of the woven textile 210 is downstream the separating area 340 and the condition of the woven textile 210 is tangled. The control unit 500 will then adapt the operation of the cutting means 360 to cut the woven textile 210, if the information from the sensor 350 says that the free end of the woven textile 210 is downstream the separating area 340 and that the condition of the woven textile 210 is tangled, so as to cut the woven textile 210 downstream the separating area 340. Further, the control unit 500 will not adapt the operation of the cutting means 360, if the information from the sensor 350 says that the free end of the woven textile 210 is downstream the separating area 340 but that the condition of the woven textile 210 is not tangled, so as to save woven textile 210 from being disposed.

Figure 7:
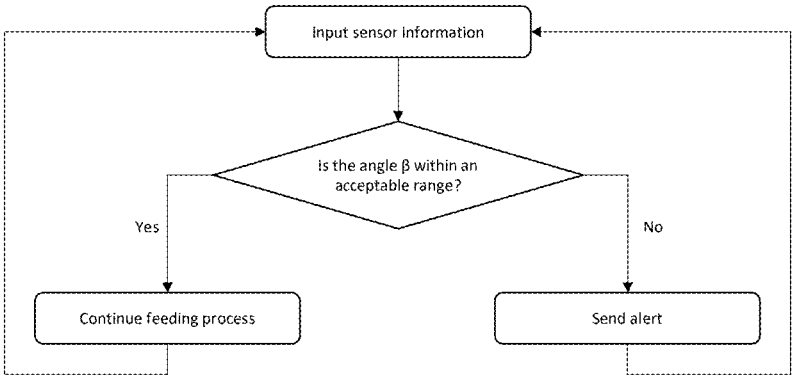
FIG. 7 is a flow chart illustrating a control unit process according to the invention.

With reference to FIG. 7, a flow chart illustrating a control unit 500 operation process according to the invention is presented. The control unit 500 receives information from the input sensor 220. The information from the input sensor 220 includes information about the value of the orientation of the woven textile, i.e. the angle β. The control unit 500 checks the value from the input sensor 220 against a predetermined range and determines if the value is inside the acceptable range or not. In an embodiment illustrated in FIG. 7, if the angle β is not within the acceptable range, the control unit 500 will send an alert to a user using the arrangement 100. The control unit 500 will repeat this action until a change occurs in the information from the sensor 220. In another embodiment, the control unit 500 sends another alert if the angle β is within the accepted range, so as to inform the user that the angle β is within the acceptable range. In another embodiment, the control unit 500 does nothing if the angle β is within the acceptable range. In one embodiment, the acceptable range is 40-50 degrees. In a preferred embodiment, the acceptable range is 42-48 degrees.

Figure 8:
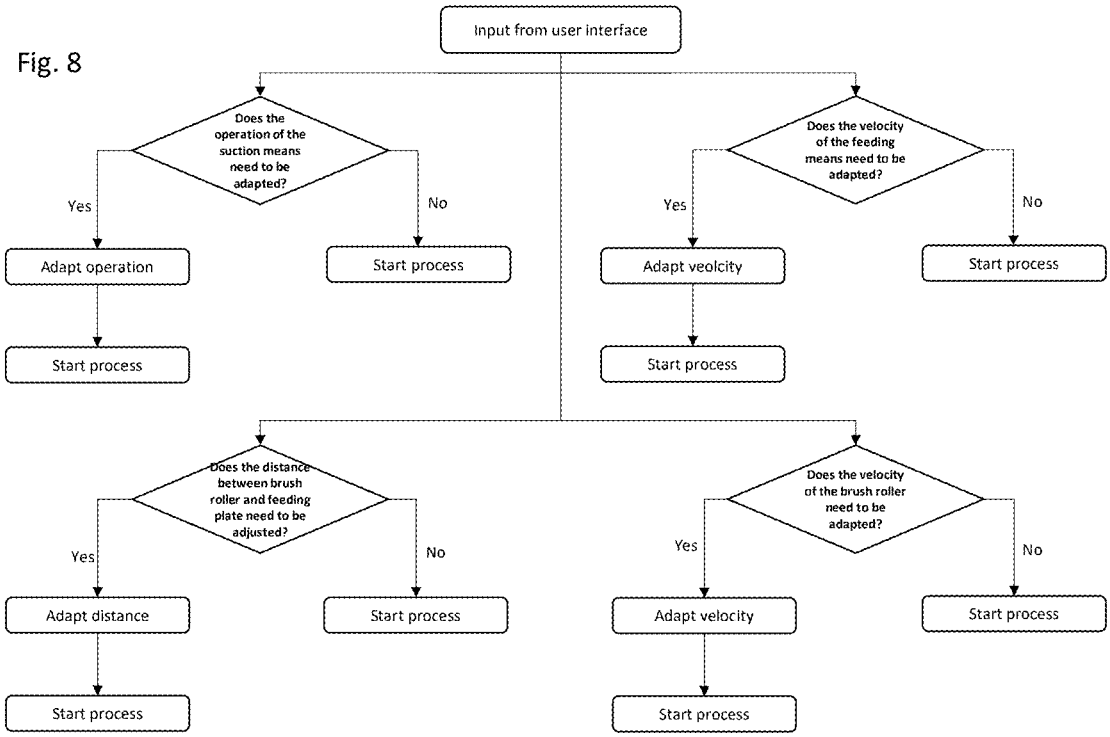
FIG. 8 is a flow chart illustrating a control unit process according to the invention.

With reference to FIG. 8, a flow chart illustrating a control unit 500 process according to the invention is presented. The control unit 500 receives information from the user interface 510. The information from the user interface 510 includes information about the characteristics of the woven textile 210. It also includes information about the number of layers of woven textile 210. Further, the user interface 510 makes it possible to provide information about the characteristics of the woven textile 210 and the number of layers of woven textile 210. For example, the characteristics of the woven textile 210 may be the textile density of the woven textile 210, the fabric thread density of the woven textile 210, the thread count of the woven textile 210, ends per inch of the woven textile 210 or picks per inch of the woven textile 210. It is clear that other types of characteristics of a woven textile are possible.

The control unit 500 reads the information from the user interface 510, and uses the information to adapt an operation of the arrangement 100. For example, shown in FIG. 8, the control unit 500 adapts the velocity of the feeding means 300 based information from the user interface 510. For example, based on information regarding the textile density of the woven textile 210, the rotational velocity of the at least two rollers 250 may have to be increased or decreased before the process of the arrangement 100 starts.

In another embodiment shown in FIG. 8, the control unit 500 adapts the operation of the suction means 430 based information from the user interface 510, so as to separate the recovered fibers 110 from the textile residual 120. For example, based on information regarding the textile density of the woven textile 210, the suction power of the suction means 430 may have to be increased or decreased before the process of the arrangement 100 starts.

In another embodiment shown in FIG. 8, the control unit 500 adapts the distance between the brush roller 310 and the feeding plate 320 based information from the user interface 510, so as to enable separating of different types of woven textiles and or number of layers of woven textile 210. For example, based on information regarding the number of layers of woven textile 210, the distance between the brush roller 310 and the feeding plate 320 may have to be increased or decreased before the process of the arrangement 100 starts.

In another embodiment shown in FIG. 8, the control unit 500 adapts the velocity of the brush roller 310 based information from the user interface 510. For example, based on information regarding the fabric thread density of the woven textile 210, the rotational velocity of the brush roller 310 may have to be increased or decreased before the process of the arrangement 100 starts.

In another embodiment, the control unit 500 determines a predetermined pressing force of the brush roller 310 towards the feeding plate 320. The predetermined force is based on information from the user interface 510. For example, based on information regarding the number of layers of the woven textile 210, the control unit 500 sets an increased or decreased predetermined pressing force before the process of the arrangement 100 starts.

Figure 9A:
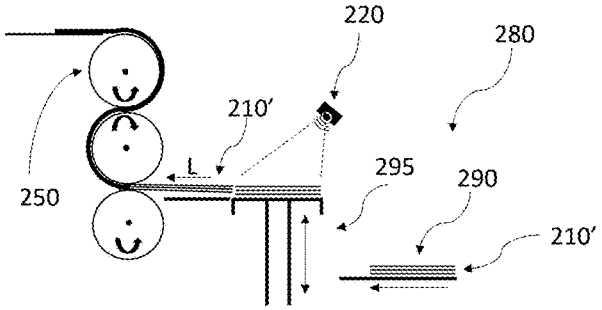
FIG. 9*a*-9*b* is a schematic view of the feeding means together with the input means according to the invention.

With reference to FIG. 9*a*, a schematic view of the feeding means 200 together with the textile orientation means 280 according to the invention is presented. The textile orientation means 280 comprises a feeding tray 290 and a lift 295. The layers of woven textile 210' are placed on the feeding tray 290 which is then transferred onto the lift 295. In one embodiment, the feeding tray may be placed on a conveyor belt in order to transfer it to the lift 295. In another embodiment, the feeding tray 290 may be transferred onto the lift 295 by a user. In another embodiment, the feeding tray may be placed on a planar surface and pushed onto the lift 295 by a pushing force from a mechanical shaft controlled by a motor. When the feeding tray 290 is placed on the lift 295, the sensor 220 monitors the warp 230 and weft 240 orientation of the layers of woven textile 210'. The sensor 220 is connected to the control unit 500 so as to check the angle β of the warp 230 and weft 240 with the acceptable range of angle β. The lift 295 is arranged to rotate so as to rotate the layers of woven textile 210' to orient the warp 230 and weft 240 to be within the acceptable range of angle β, in accordance with the information from the sensor 220. In one embodiment, the layers of woven textile 210' are all the same type of woven textile 210 placed on the lift with the same orientation. Thus, when the lift 295 rotates in order to rotate the layers of woven textile 210' for the warp 230 and the weft 240 to be within the acceptable range of the angle β, all layers of woven textile 210' are jointly rotated and resulting in the same orientation. In one embodiment, the number of layers of woven textile 210' is one. In another embodiment, the number of layers of woven textile 210' is two or more. The lift 295 is height-adjustable, so as to lift the layers of woven textile 210' to the same level as the upstream start of the feeding means. The layers of woven textile 210' may then be fed into the feeding means 200. In one embodiment, there may be a robotic arm pushing the layers of woven textile 210' from the input tray 290 into the feeding means 200. In another embodiment, the robotic arm may be another tool suitable for pushing the layers of woven textile 210' into the feeding means 200. The process of pushing the layers of woven textile 210' into the feeding means 200 may be automated and controlled by the control unit 500. In one embodiment, the lift 295 may go down again and get the next input tray 290 with layers of woven textile 210'. The lift 295 may be a motor-driven lift connected to the control unit 500.

Figure 9B:
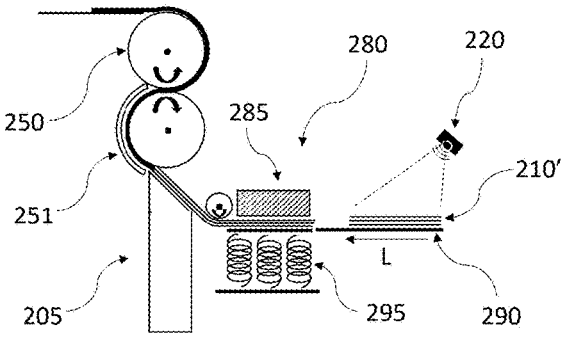

With reference to FIG. 9*b*, a schematic view of the feeding means 200 together with the textile orientation means 280 according to the invention is shown. In this embodiment, the textile orientation means 280 further comprises a support unit 285. The lift 295 includes spring loads that will press the lift towards the support unit 285. The support unit 285 is a fixed surface which the layers of woven textile 210' can be pressed against. The layers of woven textile 210' are placed on top of the lift 295, such that the layers of woven textile 210' are placed between the support unit 285 and the lift 295. When the lift lifts the layers of woven textile 210' towards the support unit 285, the layers of woven textile 210' will reach the same level as the start of the feeding means 200, and be picked up by the rollers 250 so as to enter the feeding means 200. The input tray 290 will feed more layers of woven textile 210' to the lift 295.

In one embodiment, the feeding means 200 comprises a fixture 205 with an angled surface, arranged to guide the woven textile 210 towards the rollers 250. The fixture 205 is preferably placed on the ground and the angled surface is in the opposite end, facing the feeding means 200. In this embodiment, the rollers 250 include a roller 250' arranged to guide the layers of woven textile 210' into the feeding means 200. The roller 250' is placed such that the layers of woven textile 210' are placed between the roller 250' and the fixture 205. In a preferred embodiment, the roller 250' is arranged downstream the lift 295 in the feeding direction L.

Figure 10:
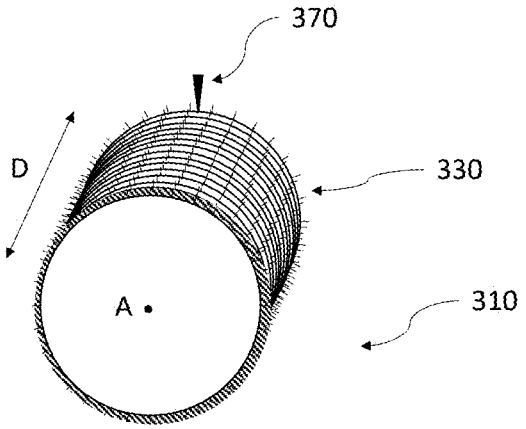
FIG. 10 is a schematic view of the brush roller according to the invention.

With reference to FIG. 10, the brush roller 310 is shown. In one embodiment, the brush roller 310 may have a cleaning process controlled by the control unit 500. The cleaning option may for example be a wire 370 that is inserted between the bristles 330. The wire 370 may be connected to the control unit 500 and for example an electrical motor that can steer the wire 370 in and out of the bristles 330 by signal from the control unit 500. The wire 370 may also be steered to move in a direction D along the rotational axis A of the brush roller 310, so as to clean the bristles 330 along the length of the brush roller 310. It is clear that other types of cleaning instruments apart from a wire 370 may be used. The brush roller 310 is rotated when the wire 370 is inserted and cleans the brush roller 310 from threads, textile fibers or residual that may be stuck between the bristles 330. The waste cleaned from the bristles can then be collected and thrown. The control unit 500 may control an operation of the cleaning process, by for example determining when the wire 370 should be inserted into the bristles 330 and for which amount of time. In one embodiment, the cleaning process may be automated to happen after a selected number of revolutions of the brush roller 310. The selected number of revolutions may be set by a user in the user 510. In one embodiment, the number of revolutions may be 10,000. In another embodiment, the cleaning process may be carried out after each use of the arrangement.

Although features and elements are described above in particular combinations, each feature or element can be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. Arrangement for separating woven textile into recovered fibers and textile residual, said arrangement comprising:

feeding means configured to feed the woven textile along a feeding direction L;

a separating unit comprising:

a feeding plate; and a brush roller with a plurality of bristles rotatably arranged around an axis of rotation substantially transverse to the feeding direction L, wherein the brush roller is arranged such that a separating area is defined between bristles of the brush roller and the feeding plate and the woven textile is separated into recovered fibers and textile residual in the separating area by rotation of the brush roller;

a fiber sorting device arranged downstream the separating unit, said fiber sorting device comprising:

a fiber collecting device configured to collect the recovered fibers, and a residual chamber configured to collect the textile residual;

a control unit configured to control an operation of the feeding means, the separating unit and the fiber sorting device;

a sensor arranged to monitor and determine the position of a downstream free end of the woven textile fed to the separating unit;

wherein the control unit is configured to, based on information from the sensor regarding the position of the downstream free end of the woven textile, control the feeding means such that the free end of the woven textile is maintained within the separating area, and wherein the fiber sorting device further comprises a suction means arranged such that the recovered fibers are separated from the textile residual and collected in the fiber collecting device.

2. An arrangement according to claim 1, wherein the control unit is configured to, based on information from the sensor, control the feeding means to rotate in a reverse direction if the free end of the woven textile is fed past the separating area along the feeding direction L.

3. An arrangement according to claim 1, wherein the separating unit further comprises a cutting means in connection with the sensor and arranged downstream the brush roller, said cutting means is configured to cut the woven textile if the free end of the woven textile is tangled along the feeding direction L.

4. An arrangement according to claim 1, further comprising an input sensor arranged to monitor an angle β, between the feeding direction L and a desired orientation of the woven textile upon insertion into the feeding means, wherein the control unit is configured to, based on information from the input sensor, determine if the angle β, is within an acceptable range, and send an alert if the angle is not within the range, and wherein the input sensor is configured to detect the orientation of the weft and/or warp of the woven textile to monitor the orientation of the woven textile.

5. An arrangement according to claim 1, wherein the feeding means comprises:

at least two rollers each rotatably arranged around an axis of rotation substantially transverse to the feeding direction L, wherein the at least two rollers are arranged such that the woven textile is lead along a curved path, wherein at least one of the at least two rollers comprises a plurality of bristles, nobs or a surface material arranged to increase a friction between the at least two rollers and the woven textile, and wherein the at least two rollers are arranged on opposite sides of the woven textile.

6. An arrangement according to claim 1, further comprising a textile orientation means arranged upstream the feeding means, and configured to orient the woven textile upon insertion into the feeding means.

7. An arrangement according to claim 1, wherein the length of the separating area along the feeding direction L corresponds to an angle α of rotation of the brush roller around the rotational axis, said angle α is within the range of 3°-15° and preferably within the range of 4°-12°.

8. An arrangement according to claim 1, wherein the bristles on the brush roller are formed of a metal material, a plastic material, natural fibers or a mix of the mentioned materials.

9. An arrangement according to claim 1, wherein the feeding plate is hard and comprises a smooth surface, and wherein at least a section of the feeding plate comprises a transparent material, and wherein the sensor is arranged below the transparent section of the feeding plate.

10. An arrangement according to claim 1, wherein a distance between the brush roller and the feeding plate is adjustable and the control unit is configured to, based on an input via the user interface regarding a number of layers of woven textile being fed into the arrangement and/or information regarding characteristic of the woven textile, adjust the distance between the brush roller and the feeding plate in the separating area, and wherein the brush roller is resiliently supported and forced towards the feeding plate with a predetermined force adapted to the number of layers of woven textile being fed into the arrangement and/or information regarding a characteristic of the woven textile.

11. An arrangement according to claim 1, further comprising a user interface connected to the control unit, and wherein the control unit is configured to, based on input via the user interface regarding a characteristic of the woven textile being fed into the arrangement, adapt the operation of the suction means such that the recovered fibers are separated from the textile residual.

12. An arrangement according to claim 7, wherein the residual chamber further comprises circulating means arranged to circulate the textile residual in the residual chamber, such that recovered fibers mixed with the textile residual in the residual chamber are released and transferred to the fiber collecting device, and wherein the fiber collecting device comprises a fiber collecting chamber and air withdrawing means configured to generate a flow of air through the fiber collecting device to direct the recovered fibers to the fiber collecting chamber.

13. A method for separating a woven textile with the arrangement according to claim 1, said method comprising the steps of:

a. inserting a woven textile into the feeding means;

b. separating the woven textile in the separating unit into recovered fibers and textile residual;

c. sorting the recovered fibers and textile residual in the fiber separation device;

d. collecting the recovered fibers from the fiber collecting chamber.

14. A method according to claim 13, wherein said arrangement further comprises a user interface connected to the control unit, and the method further comprising the step of;

setting, via the user interface, one or more, parameters regarding the woven textile required by the control unit to control an operation of the arrangement.

15. A method according to claim 13, further comprising the step a0 to be performed before step a, step a0 including;

orienting, using the textile orienting means according to claim 6 and the control unit, the woven textile in the acceptable range of the angle β.

* * * * *